United States Patent [19]

Tategami et al.

[11] Patent Number: 5,033,540

[45] Date of Patent: Jul. 23, 1991

[54] CONSOLIDATED DUPLEX HEAT EXCHANGER

[75] Inventors: Tetsuya Tategami; Hironaka Sasaki, both of Tochigi, Japan

[73] Assignee: Showa Aluminum Kabushiki Kaisha, Japan

[21] Appl. No.: 624,064

[22] Filed: Dec. 4, 1990

[30] Foreign Application Priority Data

Dec. 7, 1989 [JP] Japan ..... 1-318181

[51] Int. Cl.[5] ..... F28F 13/00; F28F 1/22

[52] U.S. Cl. ..... 165/135; 165/140; 165/153; 165/146; 165/41

[58] Field of Search ..... 165/135, 140, 141, 152, 165/153, 146, 147, 41

[56] References Cited

U.S. PATENT DOCUMENTS 1,870,457 8/1932 Keeney ..... 165/140

FOREIGN PATENT DOCUMENTS 2831022 1/1980 Fed. Rep. of Germany ..... 165/140

108394 6/1983 Japan ..... 165/135

*Primary Examiner*—Albert W. Davis, Jr.

[57] ABSTRACT

A consolidated duplex heat exchanger includes a first unit heat exchanger used for instance as a radiator, and a second unit heat exchanger employed for instance as a condenser for a car-cooler. The two unit heat exchangers are juxtaposed parallel with and close to each other, and united together by common corrugated fins each extending between cores of said unit heat exchangers. The corrugated fins are provided with cutouts intermediate the two unit heat exchangers parts so as to intercept undesirable heat conduction between said heat exchangers.

7 Claims, 3 Drawing Sheets

CONSOLIDATED DUPLEX HEAT EXCHANGER

BACKGROUND OF THE INVENTION

1. Field of the Invention

The invention relates to a consolidated duplex heat exchanger, and more particularly relates to a heat exchanger comprising different kinds of unit heat exchangers such as an engine cooling radiator and an air-conditioning condenser in automobiles wherein the unit heat exchangers are arranged parallel and consolidated into the duplex heat exchanger.

2. Description of the Prior Art

Heat exchangers for automobiles are recently required to be more compact in order to reduce the space for installation on one hand, and also to decrease works for assembling the heat exchangers on the other hand. Therefore, a pair of unit heat exchangers of different kinds are often combined to form a consolidated duplex heat exchanger in a case where the unit heat exchangers are arranged close together. Examples of such combinations of unit heat exchangers include a pair of a radiator for engine and a condenser for car cooler, a pair of a heater core and an evaporator, and a pair of the radiator and an intercooler.

One type of such consolidated heat exchangers is already disclosed in the Japanese Patent Publication Kokai 1-247990. This heat exchanger had a basic configuration as shown in FIGS. 6 and 7 wherein a second unit heat exchanger 20 constituting for instance a condenser for car cooler is installed in parallel with and in front of a first unit heat exchanger 10 constituting a radiator. These unit heat exchangers are consolidated into one duplex heat exchanger. The first unit heat exchanger has a structure such that a number of flat tubes 13 are arranged parallel with each other and connected to an upper and lower header tanks 11 and 12 in fluid communication therewith. Corrugated fins 14 are interposed between one such flat tube and the next. Similarly, the second unit heat exchanger 20 is so constructed that a number of parallel flat tubes 23 are connected at their opposite ends to an upper and lower header tubes 21 and 22, respectively, with corrugated fins 24 interposed between one such flat tube and the next.

In the above-mentioned consolidated heat exchanger, it is already proposed that, as disclosed in the above-noted Japanese Patent Publication and shown in FIG. 8, the first and second unit heat exchangers may own the same corrugated fins jointly so as to simplify the assembling process and improve the strength of connection between the two unit heat exchangers. Opposite ends of each corrugated fin are respectively connected to the unit heat exchangers.

However, the prior art consolidated heat exchanger comprising the common corrugated fins will inevitably cause thermal interference due to the continuous common fins 14 and 24 extending between the first and second unit heat exchangers 10 and 20. If the unit heat exchangers work at different temperatures, then heat from one unit heat exchanger working at a higher temperature will affect the other unit heat exchanger working at a lower temperature to thereby reduce its efficiency of heat exchange.

It will thus be necessary to increase the distance between the unit heat exchangers 10 and 20 to a satisfactory degree in order to minimize such a thermal interference. This will bring about a serious problem that the greater the distance is, the less compact would be the consolidated heat exchanger against its expected task.

OBJECT AND SUMMARY OF THE INVENTION

An object of the invention which was made to resolve such a problem is therefore to effectively avoid any significant thermal interference between a first and second unit heat exchangers, without impairing the compactness of a consolidated heat exchanger composed of the unit heat exchangers.

Another object of the invention is to prevent other unfavorable effects from taking place, in particular, to prevent condensed water produced on one unit heat exchanger from affecting other unit heat exchanger.

Still another object of the invention is to provide a consolidated heat exchanger which is easy to manufacture advantageously on commercial scale.

In order to achieve these objects, corrugated fins co-owned by the first and second unit heat exchangers operating at different temperatures are characteristically provided with one or more cutouts at intermediate horizontal portions of each fin in order to intercept heat conduction from one unit heat exchanger to the other.

The cutouts may be provided to be of any shape insofar as they intercept at least partially the continuity of the corrugated fins extending in vertical direction between the first and second unit heat exchangers. One or more notches, circular holes or the likes may be disposed at the intermediate portions of each corrugated fin, ranging top and bottom thereof. In the most preferable structure, a plurality of the notches are formed alternately from one of opposite side edges to the other of the intermediate portions and vice versa. This configuration is most advantageous because the length of heat conduction path between the two unit heat exchangers is significantly increased.

It will be apparent that in the duplex heat exchanger in accordance with the invention the cutouts formed at horizontal intermediate portions of each corrugated fin will intercept without failure the heat conduction through said corrugated fins from one unit heat exchanger to the other. As a result, the amount of heat conducted between the two unit heat exchangers is so remarkably reduced that any one of the unit heat exchangers scarcely influences thermally the other unit heat exchanger, even if they are positioned closely to each other. Thus, the mutual thermal interference is effectively avoided and it is no more necessary for the two unit heat exchangers to be spaced apart from each other such a great distance as impairing the compactness of the consolidated duplex heat exchanger.

In addition, since the duplex heat exchanger in accordance with the invention is of such a consolidated structure that the first and second unit heat exchangers co-own the common corrugated fins, the whole assembly can be built by the one-shot soldering process at a sufficiently high productivity.

Apart from the avoidance of thermal interference, the cutouts can prevent condensed water from flowing from a surface of evaporator towards a heater core in a case wherein the evaporator is the first unit heat exchanger, with the heater core being employed as the second the second unit heat exchanger. Consequently, such condensed water on the evaporator will never hinders the heater core from radiating heat.

Other objects and advantages of the invention will become apparent from the description of preferred embodiments given hereinafter.

DETAILED DESCRIPTION OF THE INVENTION

Figure 1:
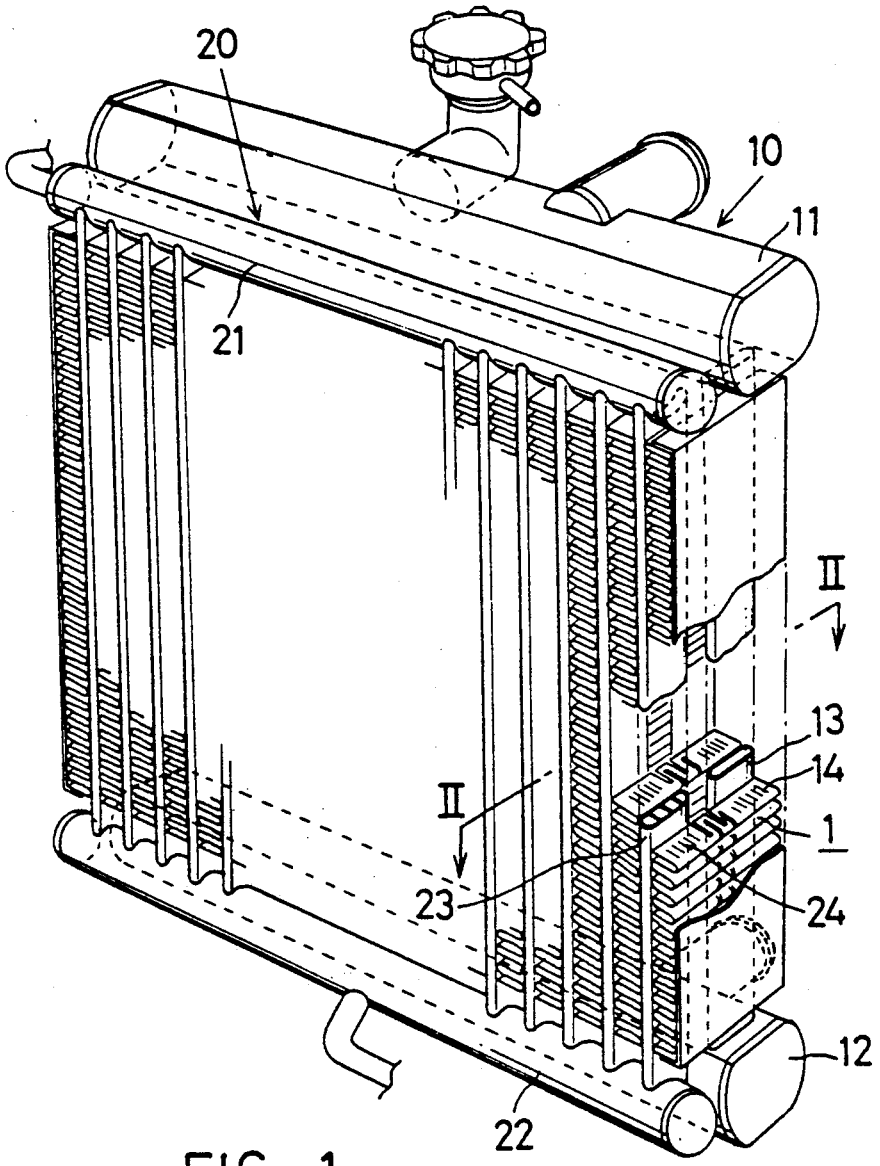
FIG. 1 is a perspective view showing in part a consolidated duplex heat exchanger according to an embodiment of the invention.
Figure 2:
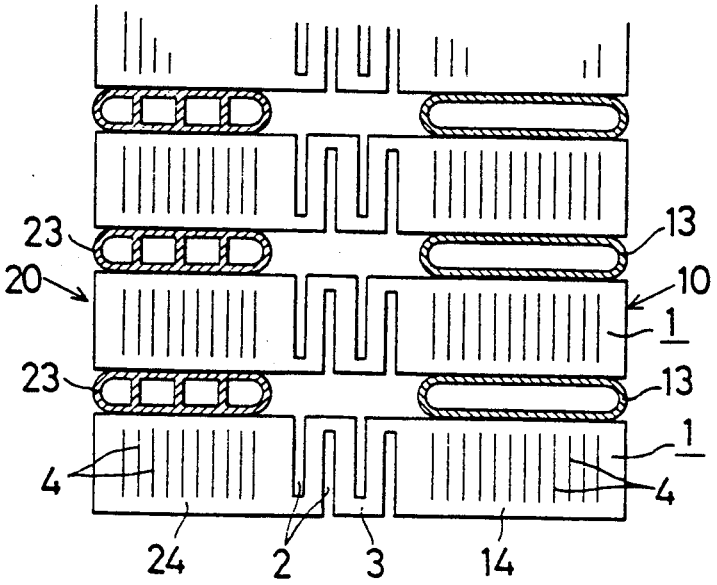
FIG. 2 is a horizontal cross section taken along a line II—II in FIG. 1 and partially showing a core part in the consolidated duplex heat exchanger.
Figure 3:
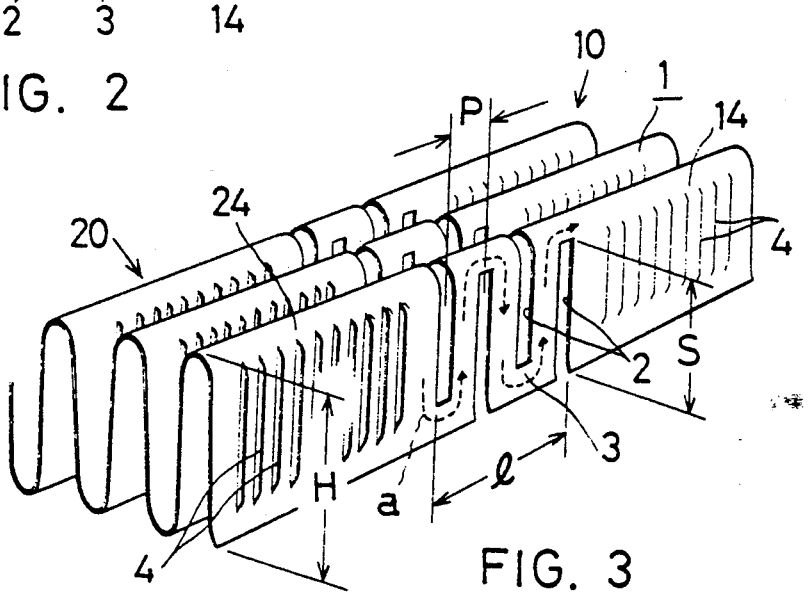
FIG. 3 is a perspective view partially showing the laid down state of a corrugated fin incorporated in the duplex heat exchanger as shown in FIGS. 1 and 2.
Figure 6:
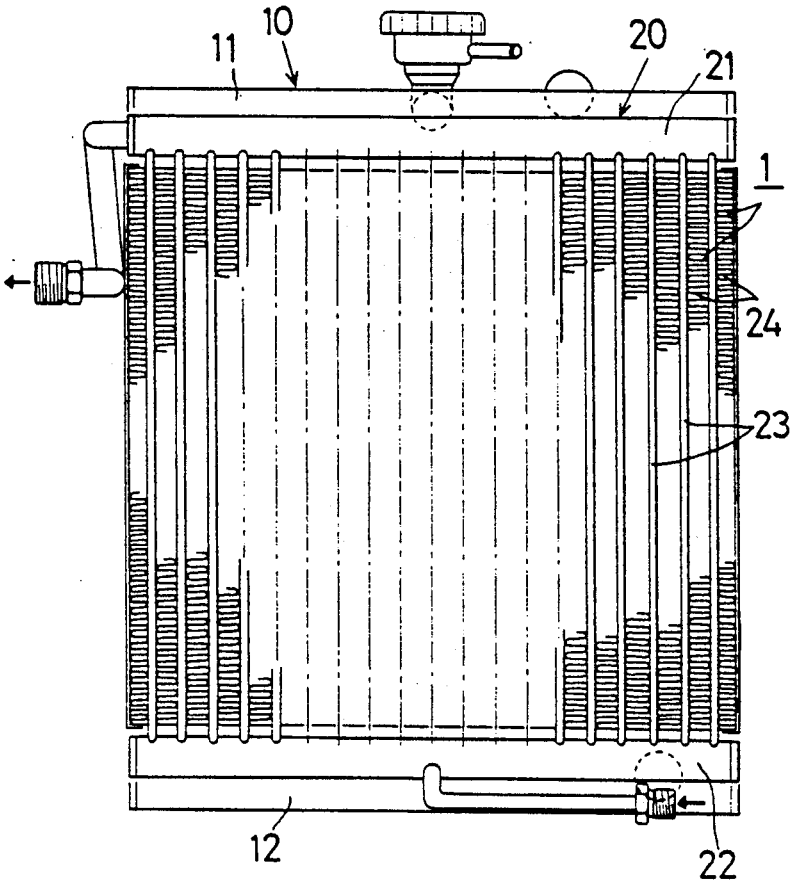
FIG. 6 (Prior Art)
FIG. 6 is a front elevation showing a prior art consolidated duplex heat exchanger as a whole.
Figure 7:
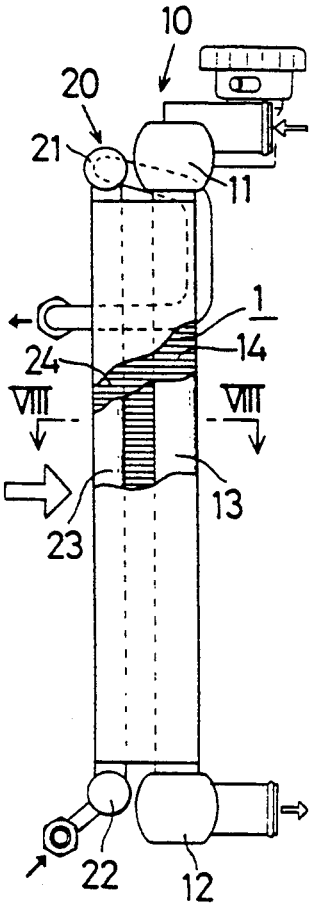
FIG. 7 (Prior Art)
FIG. 7 is a side elevation showing in part the prior art heat exchanger.
Figure 8:
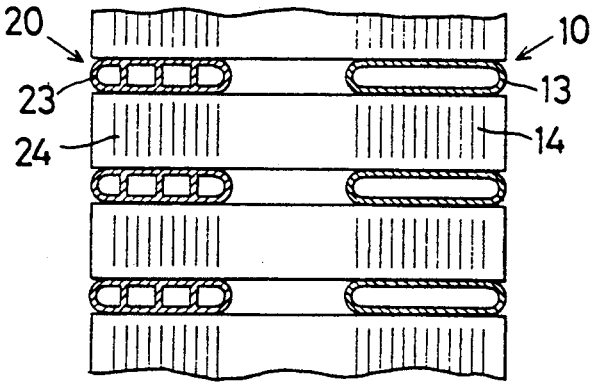
FIG. 8 (Prior Art)
FIG. 8 is a horizontal cross section taken along a line VIII—VIII in FIG. 7 and partially showing a core part.

Now referring to FIGS. 1 to 3, a consolidated duplex heat exchanger in an embodiment of the invention is basically similar to the prior art one in respect of the structures of a first and second unit heat exchangers 10 and 20 which are united together. Reference numerals which are the same in FIGS. 1 to 3 and in FIGS. 6 and 7 denote the same or similar members in the duplex heat exchangers. Corrugated fins 1 which are co-owned by the two unit heat exchangers 10 and 20 in the embodiment are however improved in a unique manner in the invention.

Each corrugated fin 1, which combines the first and second unit heat exchangers 10 and 20 in the consolidated duplex heat exchanger in the embodiment, comprises at its horizontal intermediate portion a plurality of notches 2 which function as cutouts to intercept heat conduction. The notches 2 are narrow elongate slits and are provided by cutting out portions of the fin 1 alternately in opposite directions from an edge and from another edge. The plurality of notches 2 extending in a direction of height "H" in FIG. 3 are arranged zigzag. As indicated by arrowed broken lines in FIG. 3, heat conduction path "a" extends zigzag between fin portions 14 and 24 which respectively belong to the first and second unit heat exchangers 10 and 20. In other words, the heat conduction path "a" of zigzag pattern consists of a continuous portion 3 of each corrugated fin from which the notches 2 are cut out, thereby enhancing a substantially increased length to the heat conduction path.

In one of desirable designs of the notches 2 in a case wherein the height "H" of the fins is for instance 5 to 16 mm, two or more slits 2 are arranged in alternating opposite directions within a region which extends a distance l between the first and second unit heat exchangers 10 and 20. Each notch 2 is "0.7 H" or more in height "S", and a pitch "P" of notches that is, a distance between the two adjacent notches desirably falls within a range of "0.1 H" to "0.3 H".

In the consolidated duplex heat exchanger described above, only a less amount of heat is conducted through each corrugated fin 1 because the narrow heat conduction path "a" is significantly longer than distance l between the unit heat exchangers. Owing to such a feature, the distance l between the first and second unit heat exchangers 10 and 20 can be made so short as to make more compact the duplex heat exchanger as a whole, and nevertheless the undesirable thermal interference between the two unit heat exchangers 10 and 20 can be avoided almost perfectly.

The notches 2 may be provided by the "partially slitting and bending" method to form lugs similar to louver 4 provided on the fin parts 14 and 24 belonging to the first and second unit heat exchangers 10 and 20.

Figure 4:
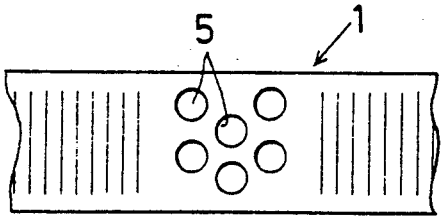
FIG. 4 is a plan view partially showing a modified type of cutouts formed in the corrugated fins.
Figure 5:
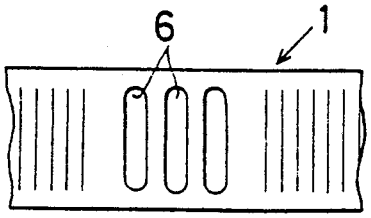
FIG. 5 is a further plan view also partially showing another modified type of the cutouts.

Further in a modification of the embodiment, the cutouts for interception of heat conduction are circular holes 5 drilled through the portions located intermediate in a direction of height of the corrugated fins, as shown in FIG. 4. In another modification, the cutouts are slots 6 drilled parallel with each other through said intermediate portions in said direction, as shown in FIG. 5. Decreased surface area of heat conduction path in both the modifications due to the cutouts 5 or 6 will play a prominent role in diminishing the heat conduction between the first and second unit heat exchangers 10 and 20.

What is claimed is:

1. A consolidated duplex heat exchanger comprising a first unit heat exchanger, a second unit heat exchanger, the two unit heat exchangers operating at different temperatures, and corrugated fins co-owned by and thereby consolidating the two unit heat exchangers into the duplex heat exchanger, the corrugated fins comprising at their intermediate portions in a direction of width one or more cutouts to intercept heat conduction between the two unit heat exchangers.

2. A consolidated duplex heat exchanger according to claim 1 wherein both the first and second unit heat exchangers comprise a pair of headers with a space between them, and a plurality of tubes disposed parallel with each other between the headers and having opposite ends in liquid communication therewith, the corrugated fins each being interposed between the two adjacent tubes.

3. A consolidated duplex heat exchanger according to claim 2 wherein the cutouts are notches formed by partially slitting the corrugated fins alternately from an edge and from another edge in opposite directions of height of the fins.

4. A consolidated duplex heat exchanger according to claim 3 wherein height "S" of the notches is "0.7 H" or more, "H" being height of the corrugated fins, and pitch "P" of the notches is "0.1 H" to "0.3 H".

5. A consolidated duplex heat exchanger according to claim 1 wherein the cutouts are circular holes drilled through the intermediate portions in a direction of height of the corrugated fins.

6. A consolidated duplex heat exchanger according to claim 1 wherein the cutouts are slots drilled through the intermediate portions in a direction of height of the corrugated fins.

7. A consolidated duplex heat exchanger according to claim 1, 2 or 3 wherein the first unit heat exchanger is a radiator used for cooling an automobile engine and the second unit heat exchanger is a condenser used for air-conditioning an automobile room.

* * * * *